United States Patent [19]

Wilkens

[11] 4,224,809

[45] Sep. 30, 1980

[54] WARP KNITTING MACHINES WITH SLIDER NEEDLES AND A FALL PLATE

[75] Inventor: Christian Wilkens, Heusenstamm, Fed. Rep. of Germany

[73] Assignee: Karl Mayer Textilmaschinenfabrik GmbH, Obertshausen, Fed. Rep. of Germany

[21] Appl. No.: 924,388

[22] Filed: Jul. 13, 1978

[51] Int. Cl.[2] ..... D04B 23/00; D04B 27/00

[52] U.S. Cl. ..... 66/207

[58] Field of Search ..... 66/203, 207, 208, 120, 66/204

[56] References Cited

U.S. PATENT DOCUMENTS

| | | | |
|---|---|---|---|
| 2,775,108 | 12/1956 | Bellini | 66/208 |
| 2,796,606 | 6/1957 | Amidon et al. | 66/204 |
| 3,469,419 | 9/1969 | Kohl | 66/207 |
| 3,561,233 | 2/1971 | Kohl | 66/207 |
| 3,568,470 | 3/1971 | Kohl | 66/207 |
| 3,681,944 | 8/1972 | Peschl et al. | 66/120 |
| 3,702,547 | 11/1972 | Peschl | 66/205 |

*Primary Examiner*—Ronald Feldbaum
*Attorney, Agent, or Firm*—Omri M. Behr

[57] ABSTRACT

A warp knitting machine having at least two guide bars, a needle bar, and a cooperating driving means utilizes a plurality of slider needles affixed to the needle bar and in combination with a trick plate member disposed between the guide bars in front of the needles is adapted to interact with the fall plate threads and the needles, to provide a trick plate weft thread lay in bound by the ground thread without the fall plate thread forming a stitch.

4 Claims, 3 Drawing Figures

WARP KNITTING MACHINES WITH SLIDER NEEDLES AND A FALL PLATE

BACKGROUND OF THE INVENTION

The present invention relates to warp knitting machines and, in particular, relates to a warp knitting machine which incorporates slider needles in addition to a fall plate member.

In the prior art, warp knitting machines conventionally utilized a track plate and associated guides to lay in a fall plate thread. These guides are affixed to a guide bar and move up and down simulating fall plate action. Typical of these is German Patent OLS No. 1,585,511. As the thread guides pass between the needles, the slider of the needle is fully opened, permitting the thread to enter the opening of the needle. The guides must swing alongside the needle, approximately at the level of the hook portion, in order to lay the appropriate thread into the hook opening. The thread is moved out of the opening by the downward movement of the thread guides so that the thread slides onto the needle shank. The thread as it is moved out of the needle opening becomes positioned under the cam on the slider, which is positioned near the tip thereof, so that the slider is in a position to move the thread in a downwardly direction as the slider moves in that direction. The position of this cam at the very top of the slider makes it more difficult to form a ground stitch, since the fall plate thread may remain stuck within the hook opening. Also, it is necessary to provide a further suspension means with steering to accomplish a fall plate-like movement of the thread guides.

Another machine, known in the prior art, wherein the guides perform a fall plate-like movement is Japanese Utility Model No. 39-19271. However, the disclosure in this patent uses compound or tubular needles which are not readily adaptable to include a cam mechanism.

A fall plate member has been used in combination with latch type needles; however, there are definite disadvantages in this approach. The use of a latch type needle requires that the needle bar be moved over a greater distance than that required for a slider needle. In addition, a fall plate, that is used in combination with the latch type needle, will be required to move a further distance in order to move the fall plate thread away from the needle opening to accomplish a fall plate thread lay in without forming a stitch with the fall plate thread.

The present invention overcomes the shortcomings found in the prior art by utilizing a fall plate member in combination with a slider needle. This permits the formation of the regular stitches in a conventional manner, since the guide members may operate as before and the needle height and the slider closure thereof remain as usual.

SUMMARY OF THE INVENTION

In a warp knitting machine according to the principles of the present invention there are provided at least two guide bars, on needle bar, and a cooperating driving means. One of the guide bars is provided with a plurality of guides for laying in ground threads and the other guide bar is provided with a plurality of guides for laying in trick plate threads. In the present machine a plurality of slider needles are affixed to the needle bar and a fall plate member is disposed in front of the needles. The fall plate member is coupled to the driving means and is adapted to interact with the fall plate thread and the needles to provide a fall plate weft thread lay in bound by the ground thread without the fall thread forming a stitch. Such coupling may be through a pattern chain or, more suitably, via a jacquard arrangement. The latter is particularly desirable if the fall plate thread is allocated a pattern forming function as well as a thread saving function.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
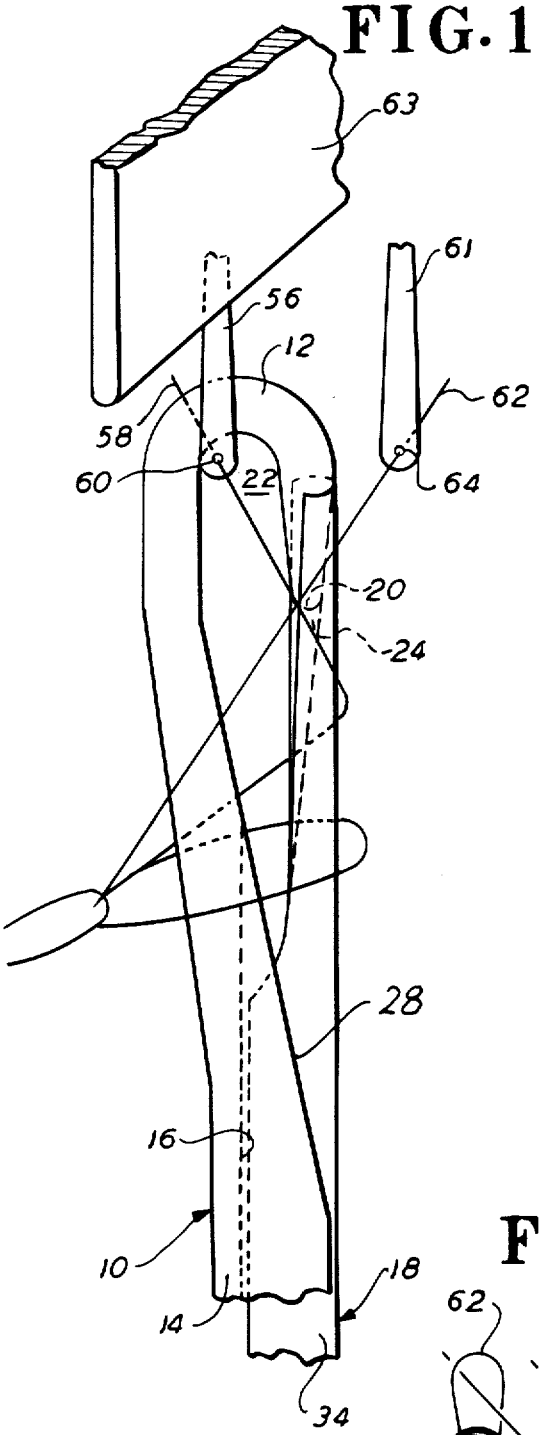
FIG. 1 is an enlarged pictorial representation of a closed slider needle, a pair of guide members, and a fall plate in position according to the principles of the present invention.
Figure 2:
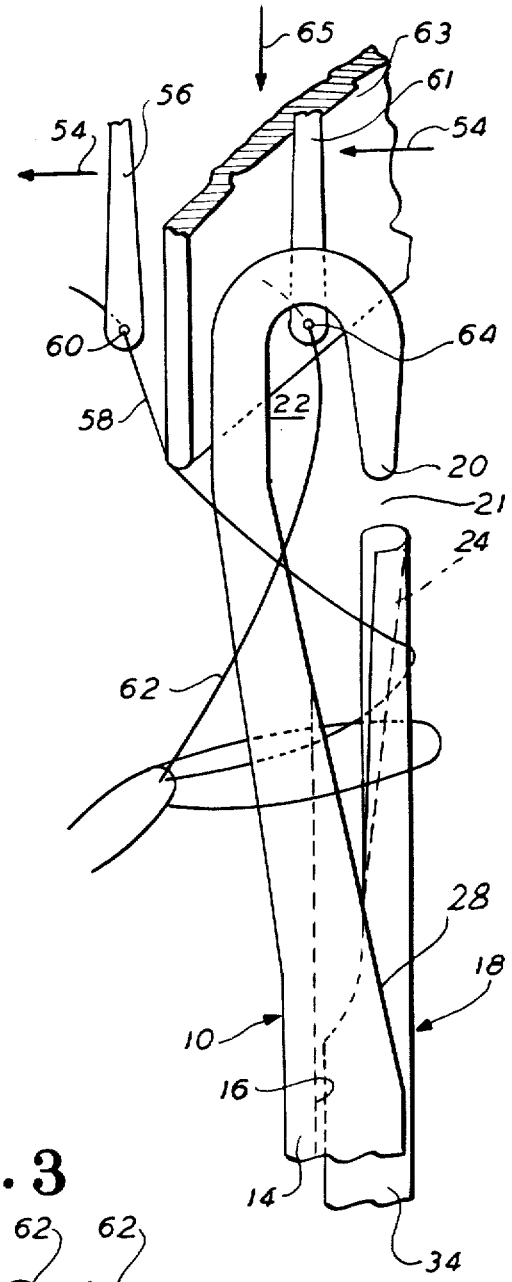
FIG. 2 is a pictorial representation of the needle shown in FIG. 1 with the slider opened and the fall plate interacting with the fall plate thread.

Referring now to the figures, and in particular to FIGS. 1 and 2, there is shown a slider needle 10 which includes a hook formed end portion 12 and a shank portion 14. The shank portion 14 is provided with a groove or slot 16 into which a slider member 18 is slidably mounted for up and down movement as shown in the figures. Slider member 18 is shown in its uppermost position in FIG. 1 where it comes into contact with the tip 20 of end portion 12. Preferably the mouth 21 of the opening 22 of the needle 10 is closed completely when the slider member 18 is in its uppermost position, although this is not necessarily required for proper operation the system may also work if the slider is opened.

With the slider in its uppermost position it extends outwardly from the edge 28 of the shank 14 in an upwardly direction closing the mouth 21 of the opening 22. The other end 34 of the slider member 18 is adapted to be coupled to the source of driving power of the warp knitting machine, not shown. The slider member 18 is provided with a narrow tip portion 24, which cooperates with the tip 20 of the hook shaped end portion in its uppermost position. Although the tip portion 24 is shown in line with the tip 20, it is understood that the tip portion 24 may be disposed alongside the tip 20.

In operation, the thread guides 56 and 61 are coupled to the driving means, not shown, and move in the direction of arrow 54, which is the forward direction relative to the warp knitting machine. When the guide 56, carrying the fall plate thread 58 in an aperture 60 provided in the end thereof, passes around the needle 10, thread 58 cannot enter the opening 22 because the slide member 18 is in its uppermost position. The fall plate thread 58 does not enter the opening 22 but instead passes over the slider 24. When the fall plate member 63 moves in a downwardly direction, in the direction of the arrow 65, it interacts with the fall plate thread 58 and moves it in a downwardly direction on to the shank portion 14 of the needle 10 as shown in FIG. 2. The ground thread guide bar 61 moves in a forwardly direction, in the direction of arrow 54, carrying ground thread 62 in aperture 64 provided in the end thereof. Since the slider member 18 has moved in a downwardly direction, an entrance path into the opening 22 is provided for the thread 62, allowing it to readily enter therein. Thus, when the needle is lowered to remove the stitch therefrom, the fall plate thread 58 is captured by the ground thread 62 which does not form a stitch by itself, thereby reducing the amount of trick plate thread stress used.

Figure 3:
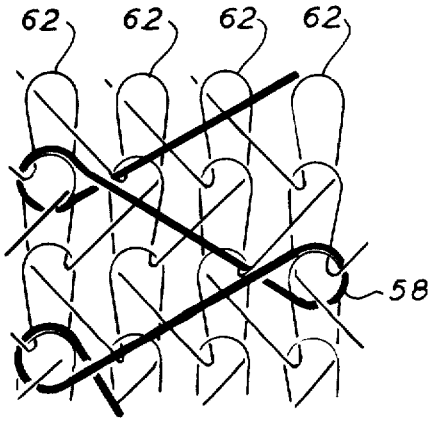
FIG. 3 is a pictorial representation of the completed stitches with the retained fall plate thread.

The formation of the stitch with the fall plate thread laid therein is shown more clearly in FIG. 3.

It is fairly obvious, to those familiar with the art, that if latch needles are used instead of the slider needles disclosed in the present invention, the fall plate 63 will be required to move a relatively large distance down the needle in order to get the fall plate thread 68 under the latch. This, of course, requires the use of a fairly substantial amount of thread. In the present embodiment, a slider needle is used in combination with a fall plate thereby saving this additional stress on the thread. Furthermore, by utilizing slider needles, the thread guide and the ground thread guide can swing through high up on the needle and the needle itself does not have to execute a very large up and down movement. The mechanism for closing the slider on the slider needle, not shown, is of course conventional.

Hereinbefore has been disclosed a means for using a fall plate in combination with a slider needle in warp knitting machines which will save substantial amounts of fall plate thread stress. It will be understood that various changes of the details, the materials, arrangement of parts and operating conditions, which have been herein described and illustrated in order to explain the nature of the invention, may be made by those skilled in the art within the principles and scope of the present invention.

Having thus set forth the nature of the invention, what is claimed is:

1. In a warp knitting machine comprising, in combination, a frame, driving means disposed within said frame, a needle bar having a plurality of slider needles affixed thereon and a depth to cooperate with said driving means, at least a pair of guidebars, one of said guidebars having a plurality of guide members affixed thereon for laying in the ground threads and the other guidebar having a plurality of guide members affixed thereon for laying fall plate threads, said guidebars being coupled to said driving means, the improvement which comprises; a fall plate member disposed between said guide bar members in front of said needles, said fall plate member being coupled to said driving means and adapted to interact with said fall plate threads and said needles whereby the fall plate stroke is reduced to provide a fall plate weft thread lay ins bound by said ground thread without the fall plate thread forming a stitch.

2. A warp knitting machine according to claim 1 wherein said fall plate thread is kept out of the opening of said needle by the slider member of said needle and is moved to the shank of said needle by said fall plate and knocked off therefrom to prevent forming a stitch by said fall plate thread.

3. In a warp knitting machine having at least two guidebars, a needle bar and a cooperating driving means, one of said guidebars being provided with a plurality of guides for laying in ground threads and the other guidebar being provided with a plurality of guides for laying in fall plate threads, the improvement which comprises, in combination:

a plurality of slider needles affixed to said needle bars; and a fall plate member disposed between said guides in front of said needles, coupled to said driving means and adapted to interact with said fall plate threads and said needles whereby the fall plate stroke is reduced to provide fall plate weft thread lay ins bound by said ground threads without the fall plate threads forming a stitch.

4. A warp knitting machine according to claim 3 wherein said fall plate movement in the downwardly direction is proximate the mouth of the opening needle in its uppermost position.

* * * * *